US005928497A

United States Patent [19]

Iaccino

[11] Patent Number: 5,928,497

[45] Date of Patent: Jul. 27, 1999

[54] HETEROATOM REMOVAL THROUGH COUNTERCURRENT SORPTION

[75] Inventor: Larry L. Iaccino, Friendswood, Tex.

[73] Assignee: Exxon Chemical Pateuts Inc, Houston, Tex.

[21] Appl. No.: 08/916,899

[22] Filed: Aug. 22, 1997

[51] Int. Cl.[6] ..... C10G 45/00

[52] U.S. Cl. ..... 208/212; 200/99

[58] Field of Search ..... 208/99, 212

[56] References Cited

U.S. PATENT DOCUMENTS

| | | | |
|---|---|---|---|
| 480,046 | 12/1892 | Zarchy | 208/99 |
| 2,759,878 | 8/1956 | Berg | 208/99 |
| 3,147,210 | 9/1964 | Hass et al. | 208/210 |
| 3,539,306 | 11/1970 | Kumura et al. . | |
| 3,657,112 | 4/1972 | Franz et al. . | |
| 3,767,562 | 10/1973 | Sze | 208/57 |
| 3,775,291 | 11/1973 | Sze | 208/57 |
| 3,796,792 | 3/1974 | Miyata et al. . | |
| 3,879,523 | 4/1975 | Miyata et al. . | |
| 3,940,330 | 2/1976 | Beuther et al. . | |
| 4,454,244 | 6/1984 | Woltermann . | |
| 4,648,959 | 3/1987 | Herber | 208/99 |
| 4,719,007 | 1/1988 | Johnson et al. | 208/99 |
| 4,770,763 | 9/1988 | Kusayanagi et al. | 208/99 |
| 5,045,175 | 9/1991 | Haizamann | 208/99 |
| 5,183,556 | 2/1993 | Reilly et al. | 208/57 |
| 5,185,135 | 2/1993 | Pillai et al. . | |
| 5,283,047 | 2/1994 | Vaughn et al. . | |

OTHER PUBLICATIONS

"Periodic Table of Elements", 64th Edition of the *CRC Handbook of Chemistry and Physics*.

*Primary Examiner*—Helane Myers
*Attorney, Agent, or Firm*—Bradley A. Keller

[57] ABSTRACT

The present invention relates to a process for heteroatom removal, particularly during process excursions, from petroleum and chemical hydrocarbon streams. The invention is comprised of at least two zones through which the hydrocarbon stream and a hydrogen containing treat gas flow. The first zone contains a bed of heteroatom hydroprocessing catalyst in contact with hydrogen-containing treat gas and the second zone contains heteroatom sorbent material(s) through which the hydrocarbon stream flows countercurrent to the up flowing hydrogen-containing treat gas.

30 Claims, No Drawings

HETEROATOM REMOVAL THROUGH COUNTERCURRENT SORPTION

This application claims priority to U.S. Provisional Patent Application No. 60/024,306, filed Aug. 23, 1996.

FIELD OF THE INVENTION

The present invention relates to a process for heteroatom removal from a petroleum and/or chemical stream. The present invention is particularly useful in the process of ensuring the desired product quality by enabling the heteroatom removal process to continue in the event of a process excursion.

BACKGROUND OF THE INVENTION

Heteroatom removal is one of the fundamental processes of the refining and petrochemical industries. Heteroatoms are defined to be those atoms other than hydrogen and carbon, present in hydrocarbon streams, including but not limited to, sulfur, nitrogen, oxygen, and halogens. These atoms are typically found as organo heteroatom molecules wherein the heteroatoms molecules make up part of the carbon hydrogen backbone. Unless otherwise specified, the expression "heteroatom" is hereafter meant to encompass the elemental form of the heteroatom itself as well as its combined counterpart species as an organic and as combined with hydrogen (i.e. organo heteroatom and hetero-hydride, respectively).

The removal of such heteroatoms by conversion to the corresponding hetero-hydride (i.e. hydrogen sulfide, ammonia, water, or hydrogen halide) is typically achieved in industry by reaction of the hydrocarbon stream containing the heteroatoms with hydrogen over a suitable hydroprocessing catalyst which is designed to meet the required product quality specifications, or to supply a low or a substantially reduced level (hereafter low is meant to also include essentially no heteroatoms) heteroatom stream to subsequent heteroatom sensitive processes, catalysts, or product dispositions.

Typically, catalytic heteroatom removal of a stream is carried out in co-current reactors in which both the preheated feed stream and a hydrogen-containing treat gas are introduced to one or more beds of heteroatom removal catalyst. The liquid feed stock, any vaporized hydrocarbons, and hydrogen-containing treat gas all flow together through the catalyst bed(s). The resulting combined vapor phase and liquid phase effluents are normally separated in a series of one or more separator vessels, or drums, downstream of the reactor.

Conventional co-current catalytic heteroatom removal has met with a great deal of commercial success; however, it has limitations. For example, because of hydrogen consumption and treat gas dilution by light reaction products, hydrogen partial pressure decreases between the reactor inlet and outlet. At the same time, any heteroatom hydroprocessing reactions that take place results in increased concentrations of hetero-hydride which strongly inhibits the catalytic activity and performance of most hydroprocessing catalysts through competitive adsorption onto the catalyst. Thus, the downstream portions of catalyst in co-current reactors are often limited in reactivity because of the simultaneous occurrence of multiple negative effects, such as the low $H_2$ partial pressure and the presence of the high concentrations of hetero-hydride.

Process excursions can occur during operation of a co-current reactor. Process excursions include events such as variation in quality or rate of the liquid feed stream or hydrogen containing treat gas stream, start-up and shut-down of the unit, emergency depressuring of the reactor to avert hazardous conditions, or other process upsets commonly experienced by commercial operating units. During such process excursions, there is a high probability that the heteroatom removal capability of the co-current reactor will be diminished and either the heteroatoms in their original form as organo heteroatom molecules or as the hetero-hydride will come in contact with the heteroatom sensitive downstream process or catalyst. Such contact may cause temporary or permanent impairment of the sensitive process or catalyst and result in unacceptable final product quality which may require significant time and expense (i.e., replacement of a poisoned catalyst) to rectify.

A bed of heteroatom sorbent can be used to protect downstream processes or catalyst but, if a bed of heteroatom sorbent is used downstream of a co-current heteroatom removal zone in co-current operation, a separation step for removal of the hetero-hydride is required. The sorbent bed's capacity can be quickly diminished if substantial heteroatom breakthrough of the upstream heteroatom hydroprocessing catalyst occurs and restoration of capacity will typically require off stream regeneration.

It is relatively well known that heteroatom removal can be accomplished more efficiently in a countercurrent flow hydroprocessing system wherein a hydroprocessing catalyst system through which the liquid hydrocarbon feedstream flows downward and the hydrogen containing treat gas is passed upward. The counter current flow system has the potential to produce significantly lower heteroatom content streams and to do so more efficiently.

While significant potential advantage exist for the application of counter current hydroprocessing; especially when coupled with the use of very high activity heteroatom sensitive catalysts, it is presently of very limited commercial use. U.S. Pat. No. 3,147,210 discloses a two stage process for the hydrofining-hydrogenation of high-boiling range aromatic hydrocarbons. The feed stock is first subjected to catalytic hydrofining, preferably in co-current flow with hydrogen, then subjected to hydrogenation over a heteroatom sensitive noble metal hydrogenation catalyst countercurrent to the flow of a hydrogen containing treat gas. U.S. Pat. No. 3,767,562 and U.S. Pat. No. 3,775,291 disclose a countercurrent process for producing jet fuels, whereas the jet fuel is first hydrodesulfurized in a co-current mode prior to two stage countercurrent hydrogenation. U.S. Pat. No. 5,183,556 also discloses a two stage co-current/countercurrent process for hydrofining and hydrogenating aromatics in a diesel fuel stream.

One reason that countercurrent flow hydroprocessing has not been more widely commercialized is that these type of reactors are more prone to deterioration in performance due to operating excursions than conventional co-current reactor systems. Process excursions include events such as variation in quality or rate of the liquid feed stream or hydrogen containing treat gas stream, start-up and shut-down of the unit, emergency depressuring of the reactor to avert hazardous conditions, or other process upsets commonly experienced by commercial operating units. During said process excursions, there is a high probability that the heteroatom removal capability of the countercurrent reactor will be diminished and either the heteroatoms in their original form as organo heteroatom molecules or as the hetero-hydride will come in contact with the heteroatom sensitive downstream process or catalyst. Said contact may cause temporary or permanent impairment of the sensitive process or catalyst and result in unacceptable final product quality which may require significant time and expense (i.e., replacement of a poisoned catalyst) to rectify.

In light of the above, there is still a need for an improved cocurrent or countercurrent heteroatom removal process, that can reliably operate under commercial plant conditions, to produce streams containing low heteroatom content.

SUMMARY OF THE INVENTION

In accordance with the present invention, there is provided a process for the heteroatom removal from a hydrocarbon stream comprising:

(a) feeding said feedstock stream to a first reaction zone comprising a bed of heteroatom hydroprocessing catalyst in contact with a hydrogen-containing treat gas wherein said first reaction zone is operating at conditions effective to remove a first portion of the heteroatom content of said feedstock stream, wherein said first portion removed from said feedstock stream is in the range of 20% to 100%;

(b) passing the liquid product stream from (a) to a sorbent zone comprising a bed of heteroatom sorbent material in contact with a hydrogen-containing treat gas wherein said liquid product stream from (a) and said hydrogen-containing treat gas are flowing in a countercurrent direction, wherein said sorbent zone is operating under conditions effective to remove a second portion of the hetero-atom from said liquid product stream from (a), wherein said second portion removed from said feedstock stream is in the range of 0% to 80%; and (c) recovering a liquid product stream from (b) wherein the amount of heteroatom remaining is in the range of from 0% to 20%, basis the starting hydrocarbon feedsteam which has not be subjected to a heteroatom removal process.

DETAILED DESCRIPTION OF THE INVENTION

While the heteroatom removal process of the present invention is applicable to all heteroatom bearing compounds common to petroleum and chemical streams, the process is particularly suitable for the removal of the least reactive, most highly refractory heteroatom species. The process of the present invention can result in a product stream which contains essentially no heteroatoms. For purposes of this invention, the phrase "essentially no heteroatoms", depends upon the overall process being considered, but can be defined as a value substantially less than about 100 wppm, preferably less than about 10 wppm, more preferably less than about 1 wppm, and most preferably less than about 0.1 wppm as measured by existing, conventional analytical technology. The invention is also applicable to consistent production of low heteroatom content streams. That is to say that in cases where steady state operation of the upstream heteroatom removal catalyst results in a steady state heteroatom concentration of X ppm; the sorbent will equilibrate with the concentration of X ppm, but when a process excursion occurs and the heteroatom concentration significantly exceeds X ppm then the sorbent will adsorb or absorb more heteroatom and prevent adverse effects on downstream catalysts or processes.

The feed stocks of the present invention are subjected to heteroatom removal in at least one catalyst bed, or reaction zone, wherein feed stock flows co-current or countercurrent to the flow of a hydrogen-containing treat gas. Each zone may be immediately preceded and followed by a non-reaction zone where products may be removed and/or feed or treat gas introduced. The non-reaction zone will be a zone which is typically empty and does not contain a catalyst that is capable of removing any heteroatoms, but it could contain a drying agent, such as a molecular sieve bed. In a preferred embodiment, such a non-reaction zone is an empty cross-section in the reaction vessel.

The liquid effluent from the reaction zone(s), is passed on to at least one sorbent zone containing one or more heteroatom sorbents in contact with a countercurrent flow of hydrogen containing treat gas. The liquid effluent, now with reduced low heteroatom content, wherein the initial level of heteroatom in the hydrocarbon feedstream is reduced by levels in the range of from about 20% to about 100%, may be sent to a heteroatom sensitive process, catalyst, or product disposition. In a preferred embodiment, the liquid effluent contains a heteroatom content which has been reduced by levels in the range from about 50% to about 100%, more preferably from about 75% to about 100%, and most preferably from about 90% to about 100%. The heteroatom sensitive process may be discrete from the countercurrent system, but is preferentially operated in countercurrent mode and may be contained within the same vessel.

In one embodiment the hydrocarbon feed steam first passes through a co-current hydrotreating reaction zone which contains one or more hydroprocessing catalyst(s). The effluent may then be passed to at least one countercurrent reaction zone containing a stacked catalyst/sorbent bed system.

During normal operation of the system, the heteroatom hydroprocessing catalyst will convert essentially all of the organo heteroatom molecules to the corresponding hetero-hydride. The hetero-hydride partitions into the vapor phase due to its inherent vapor pressure under hydroprocessing conditions and is carried upward by the up flowing hydrogen-containing treat gas. The sorbent zone sees a negligible amount of heteroatom so that its capacity is not consumed. In the event of a process upset where unreacted organo heteroatom molecules or the hetero-hydride reaction products break through the catalyst zone they will be sorbed by the heteroatom sorbent material thereby protecting the downstream heteroatom sensitive process or catalyst.

The sorbent may irreversibly bind with the sorbent which, while protecting the down stream process or catalyst, will result in the sorbent needing to be replaced or regenerated at some frequency. It is preferred that the sorbent material also catalyze or otherwise facilitate the reaction of hydrogen with the sorbed organo heteroatom molecules to form the corresponding hetero-hydride. The hetero-hydride is typically more weakly bound by the sorbent and due to its inherent high vapor pressure can be stripped from the sorbent zone by the up flowing treat gas thereby continuously regenerating the sorbent bed. A third way that the sorbent bed can function is to reversibly bind with the heteroatom and slowly release it to the down stream process or catalyst. This is allowable where the catalyst of downstream process has some tolerance for heteroatom; the tolerance being enhanced if the downstream system is operated in a countercurrent mode of operation. This third type of sorption system may also be enhanced by a small zone of heteroatom hydroprocessing catalyst placed below the sorbent bed and operated in contact with a countercurrent flow of hydrogen containing treat gas. The said additional catalyst zone will convert the organo heteroatom molecules to the corresponding hetero-hydride and allow them to be stripped from the system by the up flowing treat gas.

It is to be understood that all reaction zones and sorption zones can either be in the same vessel separated by non-reaction zones, or any can be in separate vessels. The non-reaction zones in the later case will typically be the transfer lines leading from one vessel to another. It is also possible to mix the sorbent with the catalyst in the bottom of the heteroatom removal zone or the catalyst at the top of the heteroatom sensitive catalyst zone when either or both of these zones are operated with countercurrent hydrogen containing treat gas. This mixing of catalyst and sorbent may be accomplished by mixing of the two materials prior to formulation into particles or may be accomplished by mixing of the particles after formulation into particles.

This would allow the construction of smaller volume reactors and/or the production of lower heteroatom streams than possible using conventional co-current flow reactor technology. The said low heteroatom streams can be passed on to other catalysts or processes which are extremely sensitive to poisoning by heteroatoms. This heteroatom sensitivity is sometimes sufficiently acute as to prevent the practical use of advanced catalysts. Such catalysts include those which promote ring opening, aromatic saturation, isomerization, and hydrocracking.

If a preprocessing step is performed to remove the so-called "easy heteroatoms", the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware (i.e. distributors, baffles, heat transfer devices) may be required inside the vessel(s) to provide proper temperature control and contacting (hydraulic regime) between the liquid, vapors, and catalyst.

Suitable heteroatom hydroprocessing catalyst for use in the upstream countercurrent zone(s) or co-current reaction zone(s) can be any conventional hydroprocessing catalyst and includes hydrotreating catalysts, hydrocracking catalysts, and hydrogenation catalysts; one or more may be used in either zone depending on the starting quality of the feed and the desired product quality. Most common are those which comprise at least one Group VIII metal, preferably Fe, Co and Ni, more preferably Co and/or Ni, and most preferably Ni; and at least one Group VI metal, preferably Mo and W, on a high surface area support material, which preferably is zeolite or alumina.

Some catalysts which tend to have some heteroatom sensitivity may be used in the lower portion(s) of the countercurrent reaction zone(s) due to the fact that a significant amount of heteroatom will have already been removed by the upstream catalyst and stripped out by up flowing treat gas. Catalysts suitable for said portions are those comprised of a noble or non-noble metal, or metals, of Group VIII of the Periodic Table of the Elements supported in a highly dispersed and essentially uniformly distributed manner on a refractory inorganic support.

Suitable support materials for the catalysts of the present invention include high surface area, refractory materials, such as alumina, silica, aluminosilicates, silicon carbide, amorphous and crystalline silica-aluminas, silica magnesias, boria, titania, zirconia and the like. In one embodiment, the preferred support materials include alumina and the crystalline silica-aluminas, particularly those materials classified as clays or zeolites, more preferably controlled acidity zeolites modified by their manner of synthesis, by the incorporation of acidity moderators, and post-synthesis modifications such as dealumination.

Heteroatom sorbents suitable for use in the practice of the present invention include those selected from several classes of materials known to be reactive toward the organo heteroatom molecules and in some cases the hetero-hydride and capable of binding same in either a reversible or irreversible manner.

One class of materials suitable for such use as heteroatom sorbents are reduced metals which may be employed as bulk materials or supported on an appropriate support material such as an alumina, silica, or a zeolite. Representative metals include those from Groups Ia, Ib, IIa, IIb, IIIA, IVA, VB, VIB, VIIB, VIII or the Periodic Table of the Elements (as displayed inside the front cover of the $64^{th}$ Edition of the *CRC Handbook of Chemistry and Physics*). Preferred metals include Zn, Fe, Ni, Cu, Mo, Co, Mg, Mn, W, K, Na, Ca, Ba, La, Ce, V, Ta, Nb, Re, Zr, Cr, Ag, Rh, Ir, Pd, Pt, and Sn. These metals may be employed individually or in combination.

Another class of metal based materials suitable for such use as heteroatom sorbents are metal oxides which may be employed as bulk oxides or supported on an appropriate support material such as an alumina, silica, or a zeolite. Representative metal oxides include those of the metals from Groups Ia, Ib, IIa, IIb, IIIA, IVA, VB, VIB, VIIB, VIII or the Periodic Table of the Elements. Preferred metals include Zn, Fe, Ni, Cu, Mo, Co, Mg, Mn, W, K, Na, Ca, Ba, La, Ce, V, Ta, Nb, Re, Zr, Cr, Ag, Rh, Ir, Pd, Pt, and Sn. These metal oxides may be employed individually or in combination.

A third class of metal based materials suitable for such use as heteroatom sorbents are metal sulfides which may be employed as bulk sulfides or supported on an appropriate support material such as an alumina, silica, or a zeolite. Representative metal oxides include those of the metals from Groups Ia, Ib, IIa, IIb, IIIA, IVA, VB, VIB, VIIB, VIII or the Periodic Table of the Elements. Preferred metals include Zn, Fe, Ni, Cu, Mo, Co, Mg, Mn, W, K, Na, Ca, Ba, La, Ce, V, Ta, Nb, Re, Zr, Cr, Ag, Rh, Ir, Pd, Pt, and Sn. These metal sulfides may be employed individually or in combination.

Zeolites and zeolite based materials may serve as heteroatom sorbents for this invention as detailed in U.S. Pat. No. 4,831,206 and U.S. Pat. No. 4,831,207, both of which are also incorporated herein by reference. These materials share with spinels the ability to function as regenerable heteroatom sorbents and permit operation of this invention in a mode cycling between heteroatom capture and heteroatom release in either continuous or batch operation depending upon the process configuration. Zeolites incorporating heteroatom active metals by ion exchange are also of value to this invention. Examples include Zn4A, chabazite, and faujasite moderated by the incorporation of zinc phosphate, and transition metal framework substituted zeolites similar to, but not limited to, U.S. Pat. No. 5,185,135 and U.S. Pat. No. 5,283,047, both of which are also incorporated herein by reference.

Spinels represent another class of heteroatom sorbents suitable for use in the practice of the present invention. Such materials are readily synthesized from the appropriate metal salt, frequently a sulfate, and sodium aluminate under the influence of a third agent like sulfuric acid.

Various derivatives of hydrotalcite exhibit high heteroatom capacities and for this reason serve as heteroatom sorbents for this invention. These may include numerous modified and unmodified synthetic and mineral analogs of these as described in U.S. Pat. No. 3,539,306; U.S. Pat. No. 3,796,792; U.S. Pat. No. 3,879,523; and U.S. Pat. No. 4,454,244, all of which are also incorporated herein by reference. The high molecular dispersions of the reactive metal make them very effective scavengers for heteroatom bearing molecules.

Also suitable are activated carbons and acidic activated carbons that have undergone treatment, well known to those skilled in the art, to have an enhanced acidic nature. Acidic salts may also be added to the activated carbon, used on other high surface area support or used as bulk sorbents.

The weight ratio of the heteroatom sorbent to the heteroatom removal catalyst may be in the range of from 0.01 to 10, preferably from 0.05 to 5, and more preferably from 0.1 to 1.

Preferably, the sorbent material also catalyzes or otherwise facilitates the reaction of hydrogen with the sorbed organo heteroatom molecules to form the corresponding hetero-hydride.

The countercurrent contacting of an effluent stream from an upstream reaction zone, with hydrogen-containing treat gas, strips dissolved hetero-hydride impurities from the effluent stream, thereby improving both the hydrogen partial pressure and the catalyst performance. That is, the catalyst and sorbent can be on-stream for substantially longer periods of time before regeneration is required. Further, predictable heteroatom removal levels will be achieved by the process of the present invention.

The process of this invention is operable over a range of conditions consistent with the intended objectives in terms of product quality improvement and consistent with any downstream process with which this invention is combined in either a common or sequential reactor assembly. It is understood that hydrogen is an essential component of the process and may be supplied pure or admixed with other passive or inert gases as is frequently the case in a refining or chemical processing environment. It is preferred that the hydrogen stream be heteroatom free, or essentially heteroatom free, and it is understood that the latter condition may be achieved if desired by conventional technologies currently utilized for this purpose.

The various embodiments of the present invention include operating conditions consisting of a temperature in the range of from 100 to 500° C. (212 to 930° F.), preferably from 200 to 450° C. (390–840° F.), and more preferably 225 to 400° C. (437 to 750° F.). Pressures at which the process may operated include those in the range of from 100 to 2000 psig (689 to 13,788 kPa), preferably from 400 to 1200 psig (2758 to 8273 kPa), and more preferably from 450 to 1000 psig (3102 to 6894 kPa). Gas rates at which the process may operated include those in the range of from 100 to 10,000 SCF/B (18 to 1781 $m^3$ gas/$m^3$ oil), preferably from 250 to 7500 SCF/B (45 to 1336 $m^3$ gas/$m^3$ oil), and more preferably from 500 to 5000 SCF/B (89 to 8906 $m^3$ gas/$m^3$ oil). The feed rate velocity at which the process may be operated varies in the range of from 0.1 to 100 LHSV, preferably from 0.3 to 40 LHSV, and more preferably from 0.5 to 30 LHSV.

Quite often the downstream process, catalyst, or product disposition will require that the liquid stream be at a lower temperature than was required in the heteroatom hydroprocessing steam; particularly when the downstream process/catalyst is performing aromatic saturation that is equilibrium limited at higher temperatures. When this is the case it may be desirable to perform the temperature adjustment prior to contacting the liquid stream with the heteroatom sorbent as most of the sorbents having higher sorption capacities at lower temperatures. In such applications, each of the temperature ranges described above may be decreased by as much as 100° C. (180° F.).

The hetero-hydrides formed across the heteroatom hydroprocessing catalyst have a finite solubility in the liquid stream. For this reason it may at times be desirable to include a stripping zone to remove these hetero-hydrides before passing the liquid stream to the sorbent zone. This stripping zone may be contained within the same vessel or a discrete vessel and may include any type of stripper familiar to those skilled in the art.

This invention will allow consistent levels of heteroatom concentration in a liquid effluent stream by utilizing a sorbent bed in countercurrent flow operation to sorb higher levels of heteroatoms breaking through the heteroatom hydroprocessing zone during process excursions.

The ranges and limitations provided in the specification and claims are those which are believed to particularly point out and distinctly claim the instant invention. It is, however, understood that other ranges and limitations that perform substantially the same function in substantially the same manner to obtain substantially the same result are intended to be within the scope of the instant invention as defined by the instant specification and the claims.

What is claimed is:

1. A process for heteroatom removal from a hydrocarbon feedstock stream comprising:

(a) feeding said feedstock stream to a first reaction zone comprising a bed of heteroatom hydroprocessing catalyst in contact with a hydrogen-containing treat gas wherein said first reaction zone is operating at conditions effective to remove a first portion of the heteroatom content of said feedstock stream, wherein said first portion removed from said feedstock stream is in the range of 20% to 100%;

(b) passing a liquid product stream from (a) to a sorbent zone comprising a bed of heteroatom sorbent material in contact with a hydrogen-containing treat gas wherein said liquid product stream from (a) and said hydrogen-containing treat gas are flowing in a countercurrent direction with respect to each other, wherein said sorbent zone is operating under conditions effective to remove a second portion of the heteroatom from said liquid product stream from (a) wherein said second portion removed from said feedstock stream is in the range of 0% to 80%; and (c) recovering a liquid product stream from (b) wherein the amount of heteroatom remaining is in the range of from 0% to 80%, basis the starting hydrocarbon feedstock stream which has not been subjected to a heteroatom removal process.

2. The process in claim 1 further comprising:

(d) subjecting said liquid product stream from (c) to further heteroatom sensitive processing selected from the group consisting of a process comprising heteroatom sensitive catalyst, a second heteroatom sensitive process not containing a catalyst, a heteroatom sensitive product disposition, and combinations thereof.

3. The process in claim 1 wherein said reaction zone of (a) is operated with the feedstock stream and the hydrogen containing treat gas flowing countercurrent to one another.

4. The process in claim 2 wherein said heteroatom sensitive processing of (d) comprises at least one reaction zone containing a bed of heteroatom sensitive hydroprocessing catalyst wherein said liquid product stream is processed countercurrent to a hydrogen-containing treat gas.

5. The process in claim 2 wherein said heteroatom sensitive processing of (d) is at least one reaction zone containing a bed of heteroatom sensitive hydroprocessing catalyst wherein said liquid product stream is processed co-current with a hydrogen-containing treat gas.

6. The process of claim 3 wherein said feedstock stream is first processed with a hydrogen containing treat gas in at least one co-current reaction zone containing heteroatom hydroprocessing catalyst.

7. The process of claim 1 wherein said heteroatom sorbent binds the heteroatom with sufficient binding energy so as to be essentially an irreversible sorption.

8. The process of claim 7 wherein said heteroatom sorbent is a reduced metal or metal oxide selected from the group consisting of bulk material and metal or metal oxide dispersed on a high surface area support.

9. The process of claim 1 wherein the feedstock stream contains organo heteroatom molecules and said heteroatom sorbent also catalyzes the reaction of said organo heteroatom molecules with hydrogen to produce the corresponding hetero-hydride.

10. The process of claim 9 wherein said heteroatom sorbent is a reduced metal, metal oxide, or metal sulfide selected from the group consisting of bulk material and metal, metal oxide, or metal sulfide dispersed on a high surface area support.

11. The process of claim 9 wherein the binding energy for said hetero-hydride with said sorbent is less than the binding energy of the organo heteroatom with the sorbent so that said hetero-hydride is desorbed and carried upward by the upward flowing treat gas.

12. The process of claim 11 wherein said heteroatom sorbent is a reduced metal, metal oxide, or metal sulfide selected from the group consisting of bulk material and metal, metal oxide, or metal sulfide dispersed on a high surface area support.

13. The process of claim 12 wherein said metal of the metal, metal oxide, or metal sulfide is a noble metal or combination of noble metals.

14. The process in claim 1 wherein said heteroatom sorbent binds said heteroatom with sufficiently weak binding energy so as to be essentially a reversible sorption wherein said heteroatom sorbent releases said heteroatom at a rate so as to have a negligible impact on said downstream process.

15. The process of claim 14 wherein said heteroatom sorbent is selected from the group consisting of a zeolite, alumina, clay, acidic salt, spinel, activated carbon, aluminosilicate, hydrotalcite and a combination thereof.

16. The process in claim 3 wherein said heteroatom sorbent binds said heteroatom with sufficiently weak binding energy so as to be essentially a reversible sorption wherein said heteroatom sorbent releases said heteroatom at a rate so as to have a negligible impact on said downstream process.

17. The process of claim 1 wherein said heteroatom hydroprocessing catalyst is selected from the group consisting of hydrotreating catalyst, hydrocracking catalyst, hydrogenation catalyst, hydroisomerization catalyst, ring opening catalyst, catalytic dewaxing catalyst, and a combination thereof.

18. The process of claim 6 wherein said heteroatom hydroprocessing catalyst is selected from the group consisting of hydrotreating catalyst, hydrocracking catalyst, hydrogenation catalyst, and a combination thereof.

19. The process of claim 1 wherein said heteroatom sorbent is selected from the group consisting of reduced metals, metal oxides, metal sulfides, clays, acidic salts, spinels, zeolites, activated carbon, aluminas, aluminosilicates, hydrotalcites and a combination thereof.

20. The process of claim 19 wherein the metal in said reduced metal, metal sulfide or metal oxide of the heteroatom sorbent is selected from the group consisting of Groups Ia, Ib, IIa, IIb, IIIA, IVA, VB, VIB, VIIB, VIII, and a combination thereof of the Periodic Table of the Elements.

21. The process of claim 1 wherein the temperature of said liquid product stream passing between the first reaction zone and sorbent zone is reduced, through injection of quench or heat exchange, so as to improve the sorption capabilities of the sorbent(s).

22. The process of claim 1 wherein said liquid product stream passing between the first reaction zone and sorbent zone is passed through at least one stripping zone to remove volatile hetero-hydrides before passing into the sorbent zone.

23. The process of claim 1 wherein said heteroatom sorbent is mixed into said heteroatom hydroprocessing catalyst of first reaction zone of (a).

24. The process of claim 4 wherein said heteroatom sorbent is mixed into said heteroatom sensitive hydroprocessing catalyst of further heteroatom sensitive processing (d).

25. The process of claim 2 further comprising an additional zone of heteroatom hydroprocessing catalyst placed downstream of the heteroatom sorbent bed and operated in contact with a countercurrent flow of a hydrogen containing treat gas prior to said liquid product stream being passed to (d).

26. The process of claim 14 further comprising an additional zone of heteroatom hydroprocessing catalyst placed downstream of the heteroatom sorbent bed and operated in contact with a countercurrent flow of a hydrogen containing treat gas prior to said liquid product stream being passed to (d).

27. The process of claim 1 wherein said heteroatoms are selected from the group consisting of sulfur, nitrogen, oxygen, the halogens, and mixtures thereof.

28. The process of claim 4 wherein the second heteroatom sensitive process is an aromatic saturation process.

29. The process of claim 4 wherein the second heteroatom sensitive process is a selective hydrocracking process.

30. A process for heteroatom removal from a hydrocarbon stream, where the heteroatoms are selected from the group consisting of sulfur, nitrogen, oxygen, the halogens, and mixtures thereof, said process comprising:

(a) feeding said feedstock stream to a first reaction zone comprising a bed of heteroatom hydroprocessing catalyst in contact with a hydrogen-containing treat gas wherein said first reaction zone is operating at conditions effective to remove a first portion of the heteroatom content of said feedstock stream, wherein said first portion removed from said feedstock stream is in the range of 20% to 100%;

(b) passing a liquid product stream from (a) to a sorbent zone comprising a bed of heteroatom sorbent material in contact with a hydrogen-containing treat gas wherein said liquid product stream from (a) and said hydrogen-containing treat gas are flowing in a countercurrent direction with respect to each other, where said heteroatom sorbent material is selected from the group consisting of reduced metals, metal oxides, metal sulfides, clays, acidic salts, spinels, zeolites, activated carbon, aluminas, aluminosilicates, hydrotalcites and a combination thereof, and wherein said sorbent zone is operating under conditions effective to remove a second portion of the heteroatom from said liquid product stream from (a) wherein said second portion removed from said feedstock stream is in the range of 0% to 80%; and (c) recovering a liquid product stream from (b) wherein the amount of heteroatom remaining is in the range of from 0% to 80%, basis the starting hydrocarbon feedstock stream which has not been subjected to a heteroatom removal process.

* * * * *